US005718438A

United States Patent [19]

Cho

[11] Patent Number: 5,718,438

[45] Date of Patent: Feb. 17, 1998

[54] BOUNCING ROLLER SKATES

[76] Inventor: Sung Ho Cho, 1st Dong, An Yang City, Kyungki-Province, Rep. of Korea

[21] Appl. No.: 525,268

[22] Filed: Sep. 7, 1995

Related U.S. Application Data

[63] Continuation-in-part of Ser. No. 383,176, Feb. 3, 1995, abandoned.

[30] Foreign Application Priority Data

Sep. 9, 1994 [KR] Rep. of Korea ..... 22791
Jun. 14, 1995 [KR] Rep. of Korea ..... 15740

[51] Int. Cl.[6] ..... A63C 17/02

[52] U.S. Cl. ..... 280/11.27; 301/5.3; 301/111; 301/128

[58] Field of Search ..... 280/1.165, 1.175, 280/1.191, 11.27, 11.28, 47.1, 47.41, 87.041, 87.42; 301/1, 5.1, 5.3, 5.7, 111, 128

[56] References Cited

U.S. PATENT DOCUMENTS

| | | | |
|---|---|---|---|
| 2,555,480 | 6/1951 | Fischer | 301/1 X |
| 2,557,331 | 6/1951 | Wintercorn | 280/11.28 |
| 2,708,119 | 5/1955 | Best | 301/1 X |
| 3,693,988 | 9/1972 | Steinhiser . | |
| 3,893,706 | 7/1975 | Hagen et al. . | |
| 3,999,771 | 12/1976 | Lohr . | |
| 4,120,508 | 10/1978 | Brown et al. . | |
| 4,185,847 | 1/1980 | Johnson . | |
| 4,602,822 | 7/1986 | Kim et al. | 301/1 |
| 4,817,974 | 4/1989 | Bergeron . | |
| 4,991,861 | 2/1991 | Carn et al. . | |
| 5,249,847 | 10/1993 | Lee | 301/5.1 X |

FOREIGN PATENT DOCUMENTS

| | | | |
|---|---|---|---|
| 4-22780 | 5/1992 | Japan . | |
| 1537599 | 1/1990 | U.S.S.R. | 280/1.165 |

*Primary Examiner*—Brian L. Johnson
*Assistant Examiner*—Michael Mar
*Attorney, Agent, or Firm*—Jacobson, Price, Holman & Stern, PLLC

[57] ABSTRACT

A bouncing roller skate selectively performing a bouncing motion by selective eccentric rotation of the rear wheels and providing a roller skater with thrills and satisfaction. The roller skate has front and rear brackets mounted to front and rear bottoms of an elongated shoe plate, front and rear axles rotatably supported by the front and rear brackets respectively, a pair of eccentric arm members fixed to opposite ends of the rear axle, and the rear wheels fixed to the arm members such that the rear wheels are eccentrically or concentrically rotated relative to the rear bracket and selectively bounce the roller skate up and down while roller skating. The roller skate also has spring-biased speed reduction means for reducing the eccentrically rotating speed of the rear wheel and keeping the rotating force of the rear wheel uniform, thereby maximizing the skater's motion and allowing the skater to skate safely with the greatest thrill.

15 Claims, 17 Drawing Sheets

BOUNCING ROLLER SKATES

BACKGROUND OF THE INVENTION

1. Field of the Invention

This application is a Continuation-In-Part of U.S. patent application Ser. No. 08/383,176 filed on Feb. 3, 1995 now abandoned the entire disclosure of which is incorporated herein by reference.

The present invention relates in general to roller vehicles, such as roller skates, roller blades and skate boards, and more particularly to a bouncing roller skate having a rear bracket, a rear wheel rotatably coupled to the rear bracket and eccentric means for eccentrically or concentrically coupling the rear wheel to the rear bracket and rotating the rear wheel eccentrically or concentrically relative to the rear bracket and thereby selectively performing a bounce running motion with a wave trace or a horizontal running motion with a linear trace while roller skating.

2. Description of the Prior Art

In typical roller vehicles such as roller skates, roller blades and skate boards (hereinbelow, referred to commonly as "the roller skates"), front and rear brackets are mounted on front and rear bottoms of an elongated shoe plate, to which a shoe member is attached. Front and rear axles are rotatably fitted in axle holes of the front and rear brackets with their associated bearings such that the axles smoothly rotate in the axle holes. Front and rear wheels are concentrically fixed to the front and rear axles respectively.

However, as the front and rear wheels are concentrically fixed to the front and rear axles of the above roller skate, the wheels merely rotate along with their associated axles concentrically about the center of the axles. Due to the concentric rotation of the wheels, the typical roller skate merely performs a simple horizontal running motion with a linear trace. However such a horizontal running motion of the typical roller skate does not give the skater a thrill causing the skater to be bored with roller skating.

Recently, several types of roller skates, which intend to thrill skaters when the skates are used for leisure, sports and unusual acts, have been proposed and used. However, the wheels of the above roller skates merely perform the concentric rotation in the same manner as described for the other typical roller skates so that the above roller skates are not so fun when used for leisure or sports because they do not thrill the skater.

SUMMARY OF THE INVENTION

It is, therefore, an object of the present invention to provide a bouncing roller skate in which the above problems can be overcome and which selectively performs a bounce running motion with a wave trace or a horizontal running motion with a linear trace by letting either the front or rear wheel selectively perform eccentric or concentric rotation and provides the roller skater with thrills and satisfaction.

In order to accomplish the above object, a bouncing roller skate in accordance with a preferred embodiment of the invention comprises front and rear brackets mounted to front and rear bottoms of an elongated shoe plate, front and rear axles rotatably supported by the front and rear brackets respectively, a pair of eccentric arm members fixed to opposite ends of the rear axle, and a pair of rear wheels fixed to the arm members such that the rear wheels are eccentrically rotated relative to the rear bracket and bounce the roller skate up and down while roller skating.

It is another object of the present invention to provide a bouncing roller skate which has spring-biased speed reduction means for reducing the eccentrically rotating speed of the rear wheel and keeping the rotating force of the rear wheel uniform, thus maximizing quantity of the skater's motion and allowing the skater to skate safely with the greatest thrill.

In an embodiment of the invention, the speed reduction means has an elongated spring hole formed in the rear bracket above the rear axle, the lower portion of the spring hole having a step; a spring received in the spring hole; a stopper interposed between the spring and the rear axle and movably seated on the step of the spring hole, the stopper selectively applying frictional contact force for the rear axle and acting as a brake for the axle; and a spring force adjusting screw fitted in the top of the spring hole such that the screw is driven at the outside of the rear bracket.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
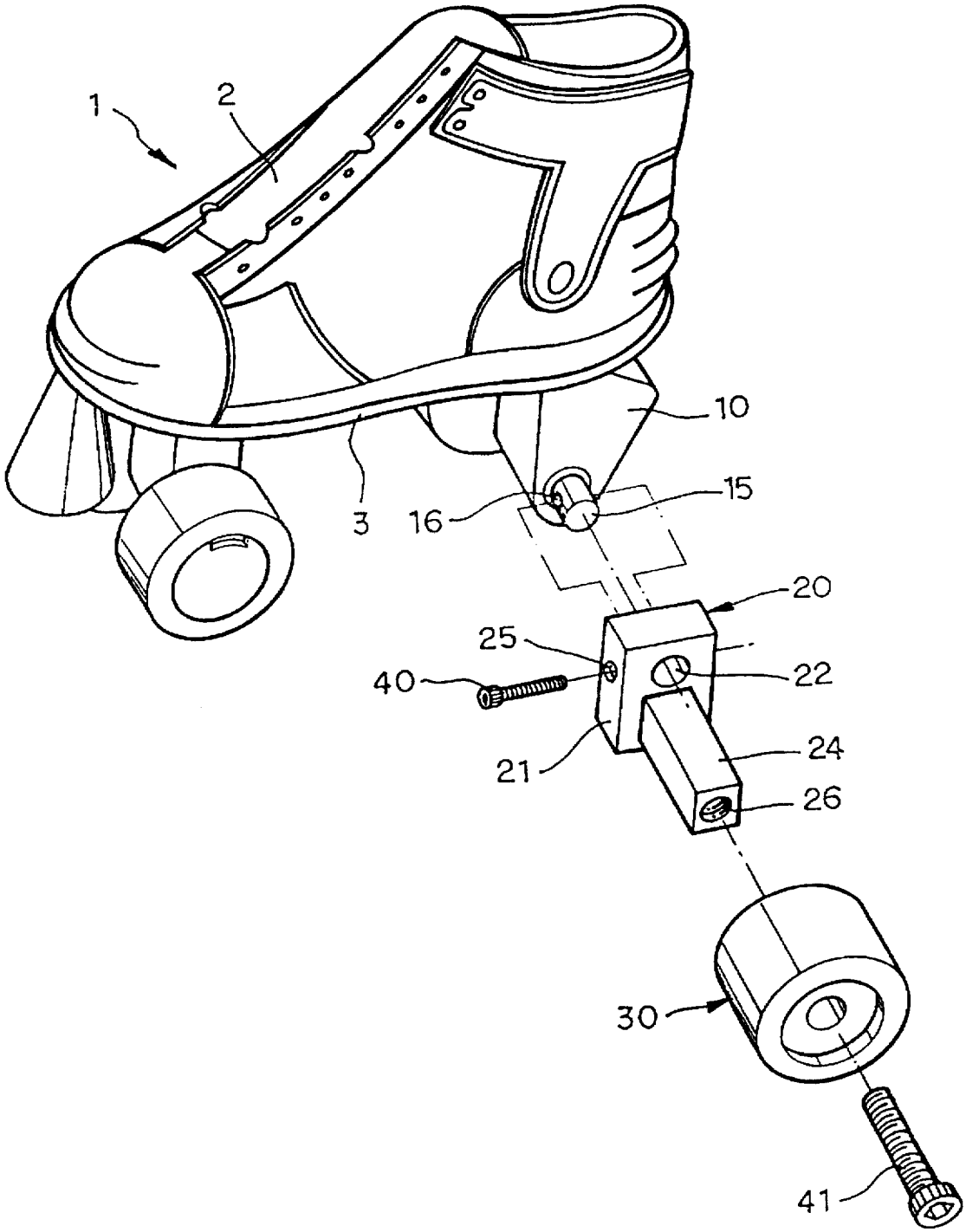
FIG. 1 is an exploded perspective view of a bouncing roller skate having a pair of eccentric arm members as eccentric means in accordance with a primary embodiment of the present invention.

FIG. 1 is an exploded perspective view of a bouncing roller skate in accordance with a primary embodiment of the present invention. This drawing shows an eccentric arm member 20 and a rear wheel 30 which are separated from a rear wheel bracket 10.

The above roller skate 1 includes a shoe 2 which is attached to an elongated shoe plate 3. Front and rear bottoms of the shoe plate 3 are provided with front and rear brackets 10 respectively. A front axle is rotatably fitted in the front bracket 10 with interposition of bearing means (not shown). A pair of front wheels are fixed to the opposite end portions of the front axle. The roller skate 1 also includes eccentric means for eccentrically or concentrically coupling the rear wheels to the rear bracket and rotating the rear wheels eccentrically or concentrically relative to the rear bracket 10 and thereby selectively performing a bounce running motion with a wave trace or a horizontal running motion with a linear trace while roller skating.

In the primary embodiment, the eccentric means includes a rear axle 15 which is rotatably fitted in the rear bracket 10 transversely with interposition of bearing means. Each end portion of the rear axle 15 has an arm fixing hole 16. The opposite arm fixing holes 16 of the axle 15 are radially formed on the outer surface of the axle 15 such that the holes 16 are exposed to the outside of the bracket 10.

The eccentric means also includes a pair of eccentric arm members 20 which are fixed to the opposite end portions of the rear axle 15. Each arm member 20 comprises a rectangular arm block 21 having axle support means 22. The means 22 is formed on one side surface of the block 21. A wheel shaft 24 of square cross-section integrally extends from the other surface of the block 21 outward. The rear wheel 30 having a rectangular center shaft hole is fitted over the wheel shaft 24. The wheel 30 is, thereafter, fixed to the wheel shaft 24 by means of a set screw 41 so that the wheel 30 can not rotate relative to the arm 20.

Figure 2:
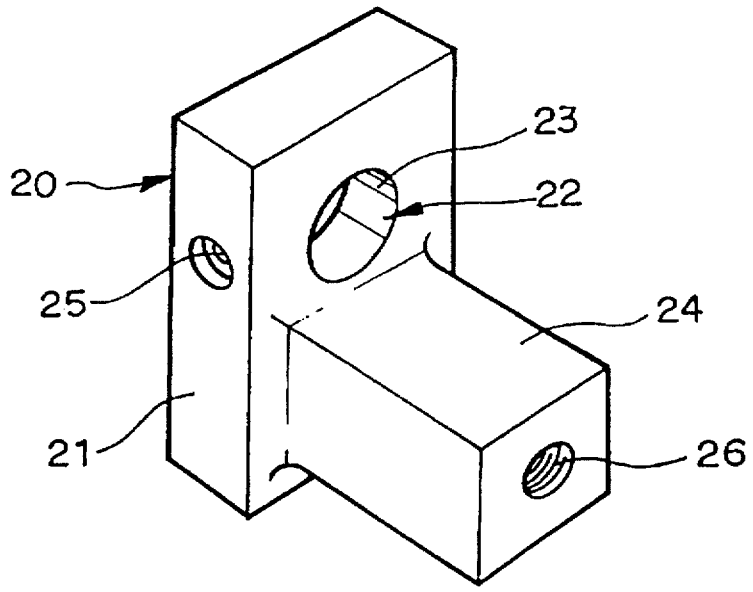
FIG. 2 is a perspective view of a first embodiment of an eccentric arm member of the roller skate of the invention, the arm member having one axle support hole as axle support means.

Turning to FIG. 2, there is shown a first embodiment of the arm member 20. In this embodiment, the axle support means 22 formed in the arm block 21 comprises one support hole 23. An axle fixing hole 25 is transversely formed in the block 21 such that the fixing hole 25 is perpendicular to and communicates with the support hole 23. A wheel fixing hole 26 is longitudinally formed in the center of the wheel shaft 24.

Figure 3:
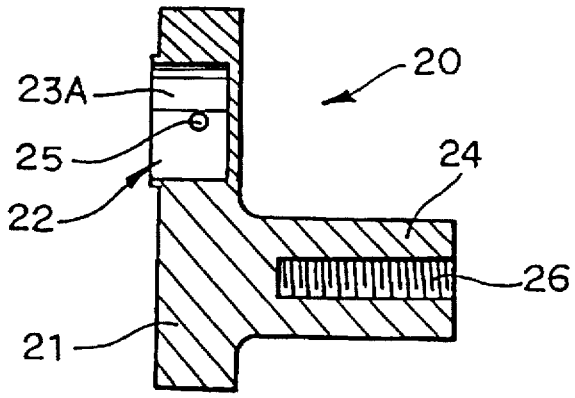
FIG. 3 is a sectional view of a second embodiment of the eccentric arm member of this invention, the arm member having one axle support recess as axle support means.

FIG. 3 is a sectional view of a second embodiment of the arm member 20. The general shape of this arm member 20 remains the same as in the arm member 20 of FIG. 2, but the axle support means 22 formed in the arm block 21 comprises one support recess 23A instead of the support hole 23.

Figure 4A:
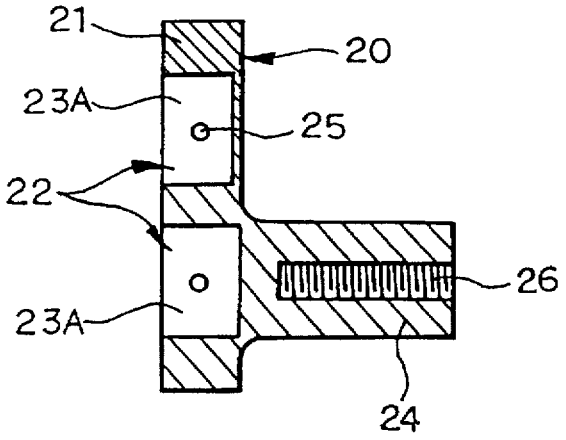
FIG. 4A is a sectional view of a third embodiment of the eccentric arm member of this invention, the arm member having two axle support recesses as axle support means.
Figure 4B:
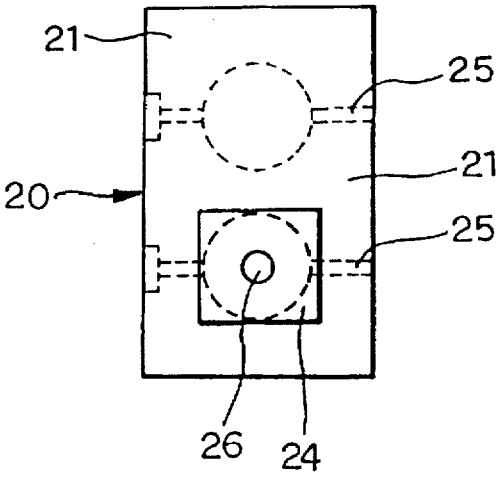
FIG. 4B is a right side view of the arm member of FIG. 4A.

Referring next to FIGS. 4A and 4B, there is shown a third embodiment of the arm member 20. In this embodiment, the axle support means 22 of the arm block 21 comprises two support recesses 23A. Two axle fixing holes 25 are formed in the block 21 such that the fixing holes 25 are perpendicular to and communicate with their associated support recesses 23A. In this arm member 20, the wheel fixing hole 26 is longitudinally formed in the center of the wheel shaft 24 in the same manner as described for the first embodiment of the arm member 20.

Figure 5A:
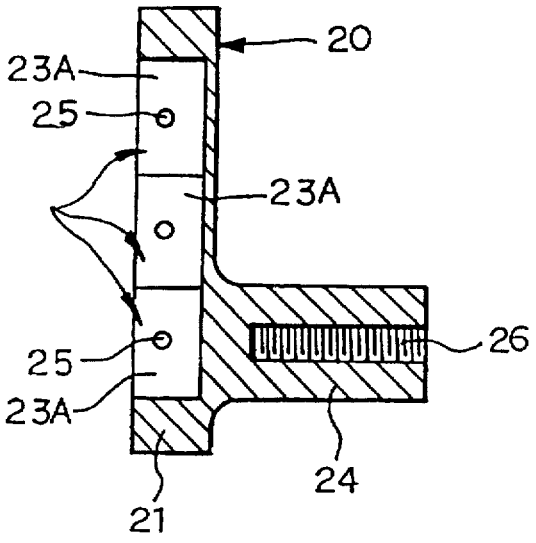
FIG. 5A is a sectional view of a fourth embodiment of the eccentric arm member of this invention, the arm member having three axle support recesses as axle support means.
Figure 5B:
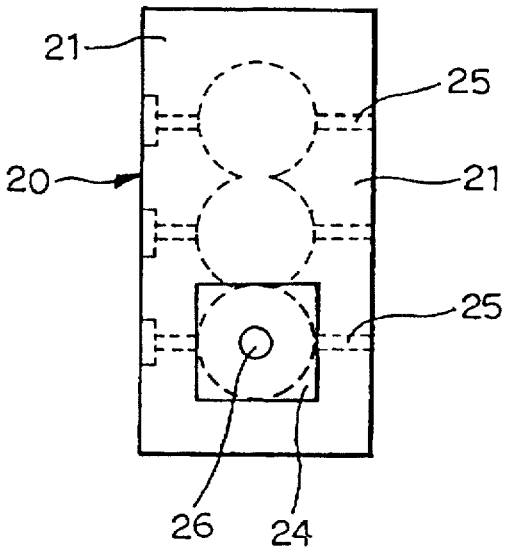
FIG. 5B is a right side view of the arm member of FIG. 5A.

FIGS. 5A and 5B show a fourth embodiment of the arm member 20. In this embodiment, the axle support means 22 of the arm block 21 comprises three support recesses 23A. Three axle fixing holes 25 are formed in the block 21 such that the fixing holes 25 are perpendicular to and communicate with their associated support recesses 23A.

In the above fourth embodiment of the arm member 20, the support recesses 23A which are vertically arranged in the block 21 are close to each other such that the recesses 23A partially overlap each other and communicate with each other.

That is, the axle support means 22 of the arm member 20 used in the bouncing roller skate of this invention may be either the support hole 23 or the support recess 23A in accordance with configuration of the rear axle 15. The means 22 also may have either rectangular or circular shape. Please note that the means 22 in the above embodiments have the circular shape, for example.

Of course, it should be understood that the axle support means 22 of each arm member 20 may have four or five support recesses 23A which are vertically arranged in the block 21 such that the recesses 23A communicate with each other.

Figure 6:
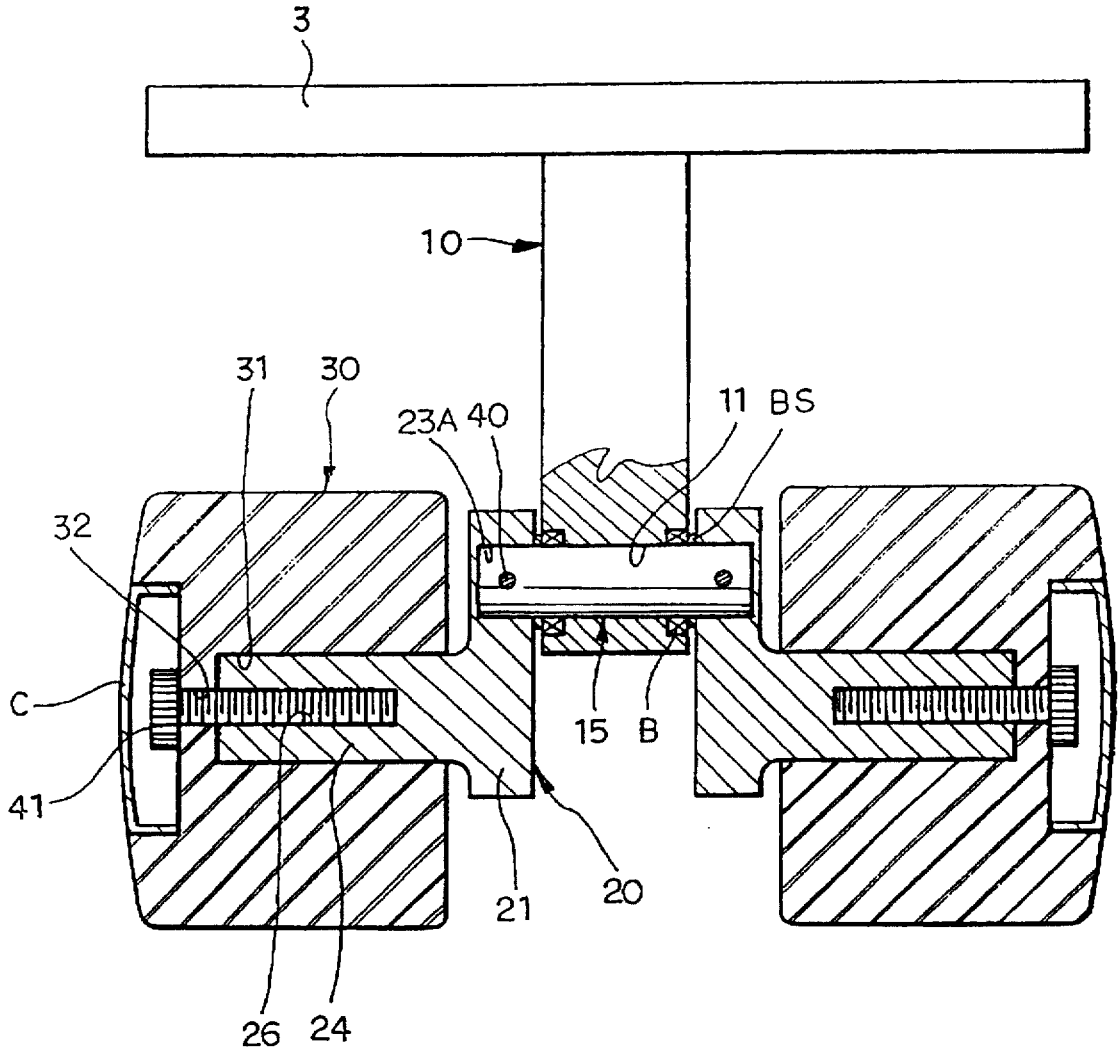
FIG. 6 is a sectional view of a rear wheel part of the roller skate of this invention, showing two rear wheels eccentrically coupled to the rear axle using the arm member of FIG. 3.

FIG. 6 is a sectional view showing the rear wheels 30 eccentrically coupled to the rear axle 15 using the arm members 20 of FIG. 3. As shown in FIG. 6, the rear bracket 10 is fixed to the rear bottom of the shoe plate 3. The cylindrical rear axle 15 is rotatably fitted in the rear bracket 10 transversely using a pair of bearings B such that the opposite end portions of the axle 15 are exposed to the outside of the bracket 10.

When the rear wheels 30 are eccentrically coupled to the rear axle 15 using the arm members 20 of FIG. 3, the arm members 20 are fitted over the exposed end portions of the rear axle 15 respectively by inserting the opposite end portions of the axle 15 into the support recesses 23A of the arm members 20 respectively.

When the above arm members 20 are fixed to the opposite end portions of the axle 15, the axle fixing holes 25 of the arm members 20 should be aligned with their associated arm fixing holes 16 of the axle 15. Thereafter, a wrench bolt 40 is inserted into each axle fixing hole 25 and tightened to fix each arm member 20 to an associated end portion of the axle 15.

Thereafter, the rear wheels 30 are fitted over the wheel shafts 24 of the arm members 20 respectively by inserting the shafts 24 into center shaft holes 31 of the rear wheels 30. The rear wheels 30 are, thereafter, fixed to their associated wheel shafts 24 by means of the set screws 41. In this case, the set screws 41 are inserted into the screw holes 26 of the shafts 24 through center screw holes 32 of the wheels 30.

In FIG. 6, the reference character BS denotes a bush fitted over the axle 15 between the rear bracket 10 and each arm member 20 and the reference character C denotes a wheel cap of each rear wheel 30.

Figure 9:
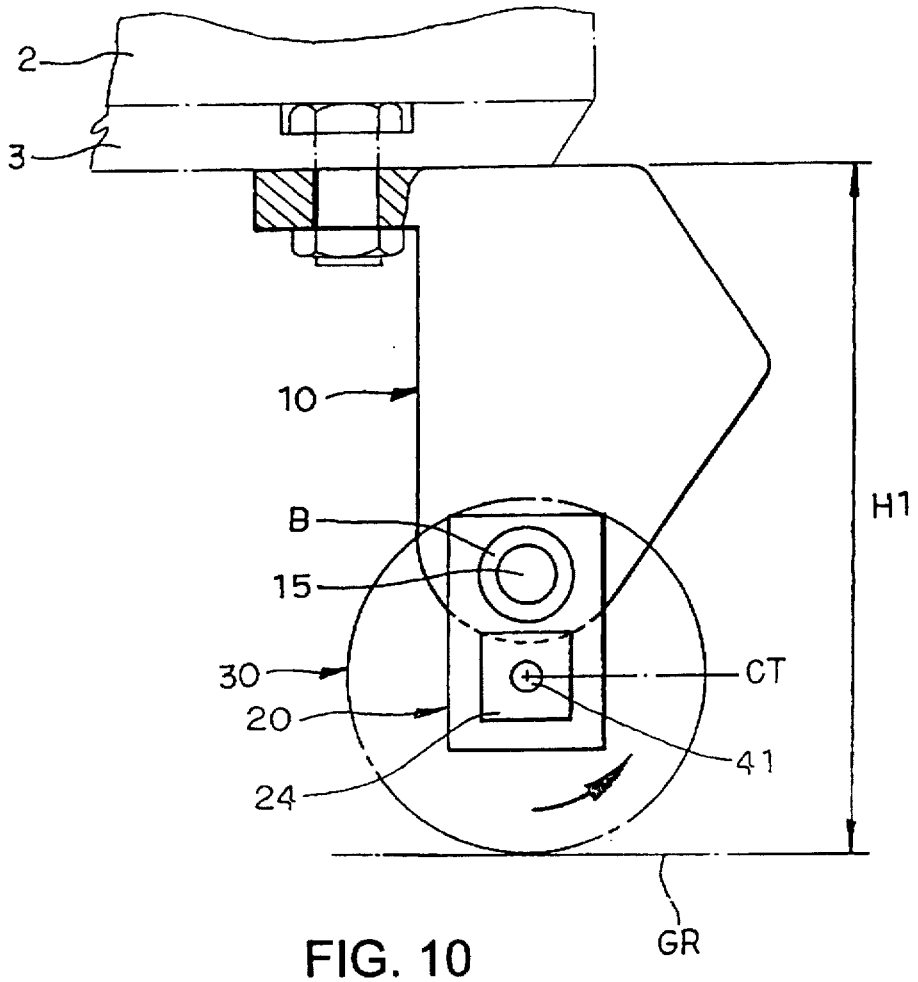
FIG. 9 is a side view of the rear wheel part of the roller skate of this invention, showing the initial position of the rear wheel during eccentric rotation of the wheel.

In operation of the above bouncing roller skate of FIG. 6, the rear wheels 30 will be temporarily in the initial position or the lowest position as shown in FIG. 9. In the above lowest position, the center CT of the rear wheels 30 fixed to the wheel shafts 24 of the arm members 20 is positioned under the center of the axle 15.

When the front and rear wheels of the roller skate 1 in the state of FIG. 9 are rolled forward, the rear wheels 30 eccentrically rotate about the center of the axle 15 in the direction of the arrow in FIG. 9.

As the rear wheels 30 in this case are fixedly fitted over the rectangular wheel shafts 24 of the arm members 20, the arm members 20 also rotate about the center of the axle 15 in the same direction.

Figure 10:
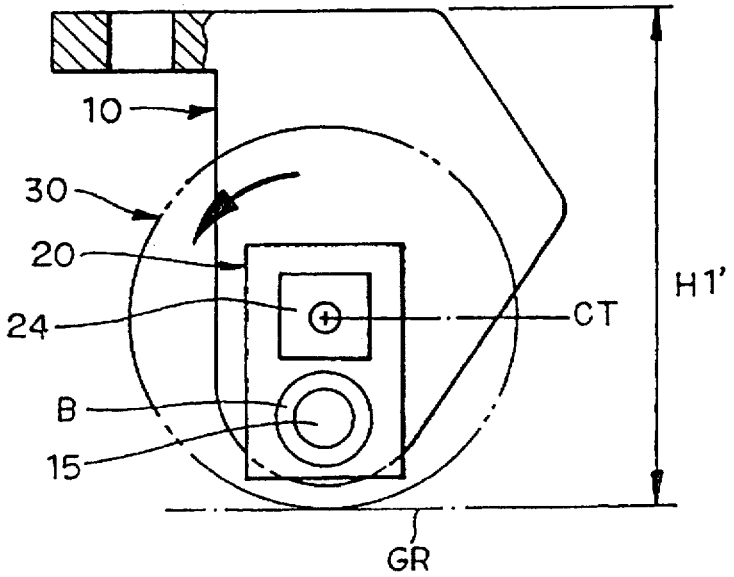
FIG. 10 is a view corresponding to FIG. 9, but showing the uppermost position of the rear wheel.

Therefore, the rear wheels 30 along with the arm members 20 reach the highest position as shown in FIG. 10. In this highest position, the center CT of the rear wheels 30 is positioned above the axle 15. Therefore, the height between the ground GR and the outer bottom of the shoe plate 3 changes from the height H1 of FIG. 9 to the height H1' of FIG. 10.

When the roller skate 1 in the state of FIG. 10 is further rolled forward, the rear wheels 30 return to the lowest position of FIG. 9. In the above lowest position, the center CT of the rear wheels 30 is positioned under the axle 15. Therefore, the height between the ground GR and the outer bottom of the shoe plate 3 changes from the height H1' of FIG. 10 to the height H1 of FIG. 9. That is, the height between the ground GR and the outer bottom of the shoe plate 3 can be changed due to the eccentric rotation of the wheels 30. Therefore, the roller skate 1 bounces up and down with a wave trace while roller skating.

Figure 7:
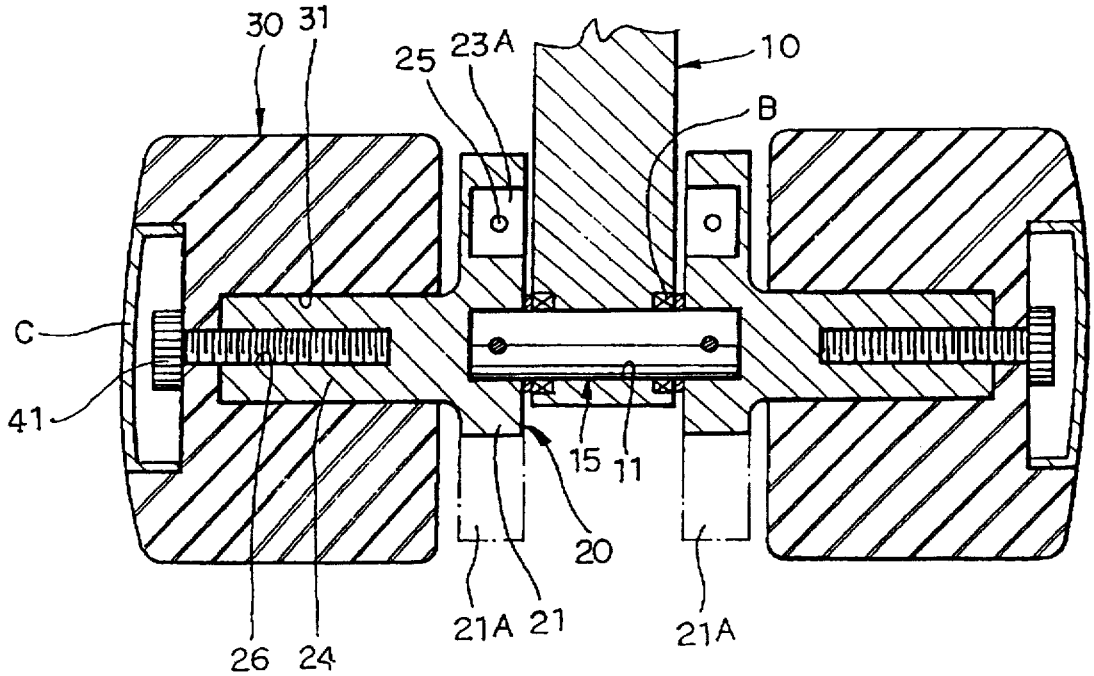
FIG. 7 is a view corresponding to FIG. 6, but showing the two rear wheels concentrically coupled to the rear axle using the arm member of FIGS. 4A and 4B.

Turning to FIG. 7, there is shown the rear wheels 30 concentrically coupled to the rear axle 15 using the arm members 20 of FIGS. 4A and 4B. As shown in FIG. 7, the cylindrical rear axle 15 is rotatably fitted in the axle hole 11 of the rear bracket 10 with interposition of the bearings B such that the opposite end portions of the axle 15 are exposed to the outside of the bracket 10.

When the rear wheels 30 are coupled to the rear axle 15 using the above arm members 20, each end portion of the axle 15 is inserted into either support recess 23A of an associated arm member 20.

As described above, the arm member 20 of the second embodiment has two support recesses 23A, that is, a concentric support recess 23A and an eccentric support recess 23A. The concentric support recess 23A of each arm member 20 is leveled with the center of the wheel shaft 24 of the arm member 20, while the eccentric support recess 23A is eccentric from the center of the shaft 24. When the arm members 20 are fixed to the axle 15 by inserting the axle 15 into the concentric support recesses 23A of the arm members 20 as shown in FIG. 7, the center CT of the rear wheels 30 are aligned with the center of the axle 15. In this case, the roller skate 1 will roll on the ground GR in the same manner as described for a typical roller skate.

However, when the arm members 20 are fixed to the axle 15 by inserting the axle 15 into the eccentric support recesses 23A of the arm members 20, the center CT of the rear wheels 30 will be eccentric from the center of the axle 15. In this case, the rear wheels 30 will perform the above-described eccentric rotation relative to the rear bracket 10 and bounce the roller skate 1 up and down.

Figure 8:
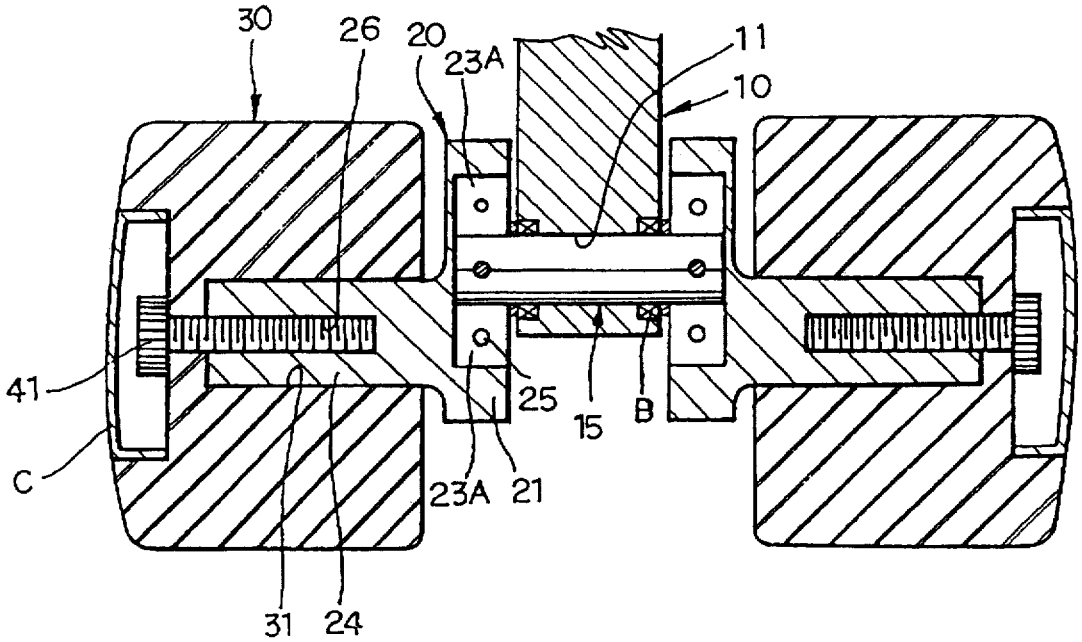
FIG. 8 is a view corresponding to FIG. 6, but showing the two rear wheels eccentrically coupled to the rear axle using the arm member of FIGS. 5A and 5B.

Turning to FIG. 8, there is shown the rear wheels 30 eccentrically coupled to the rear axle 15 using the arm members 20 of FIGS. 5A and 5B. Each arm member 20 of the fourth embodiment has three support recesses 23A, that is, a concentric support recess 23A and two eccentric support recesses 23A. When the arm members 20 are fixed to the axle 15 by inserting each end portion of the axle 15 into one of the support recesses 23A of an associated arm member 20, the rear wheels 30 either roll on the ground GR in the same manner as described for a typical roller skate or eccentrically roll on the ground GR while bouncing the roller skate up and down.

As each arm member 20 of FIG. 5A and 5B has two eccentric support recesses 23A which have different eccentricity from the center CT of the rear wheels 30, the roller skate 1 having the above arm members 20 may select one of two types of bouncing motions.

Figure 29:
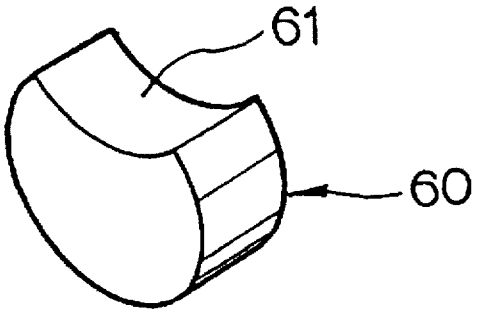
FIG. 29 is a perspective view of a spacer to be fitted in axle support means of an arm member of this invention.
Figure 30:
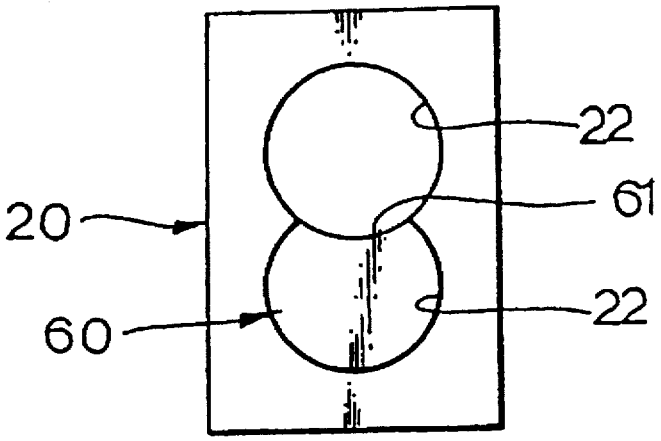
FIG. 30 is a view showing the spacer of FIG. 29 fitted in the axle support means of the arm member.

The support recesses 23A vertically arranged in each arm member 20 of FIGS. 5A and 5B overlap each other such that the recesses 23 communicate with each other as described above. When the rear wheels 30 are coupled to the axle 15 using the above arm members 20, a spacer 60 having a support surface 61 as shown in FIG. 29 may be preferably inserted in an empty support recess 23A of each arm member 20 as shown in FIG. 30. The spacer 60 not only improves axle coupling precision but also allows the axle 15 to perform smooth rotation.

The arm member 20 of FIGS. 5A and 5B having the plurality of support recesses 23A overlapping each other has an advantage in that many support recesses 23A can be formed in the arm member 20 with a limited area. In addition, the roller skate 1 having the above arm members 20 may select one of various types of bouncing motions due to the support recesses 23A.

Figure 31:
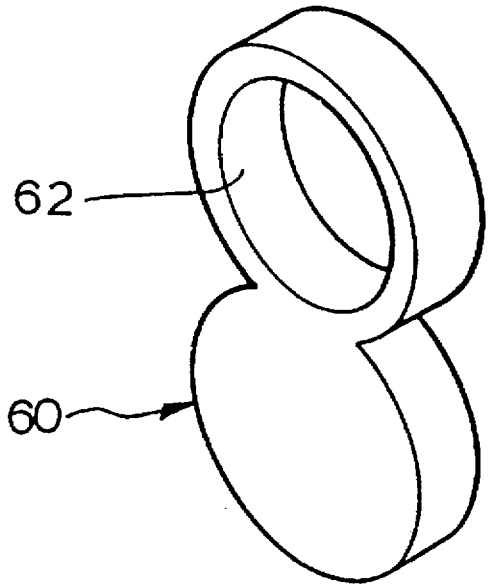
FIG. 31 is a perspective view of another embodiment of the spacer to be fitted in axle support means of an arm member of this invention.
Figure 32:
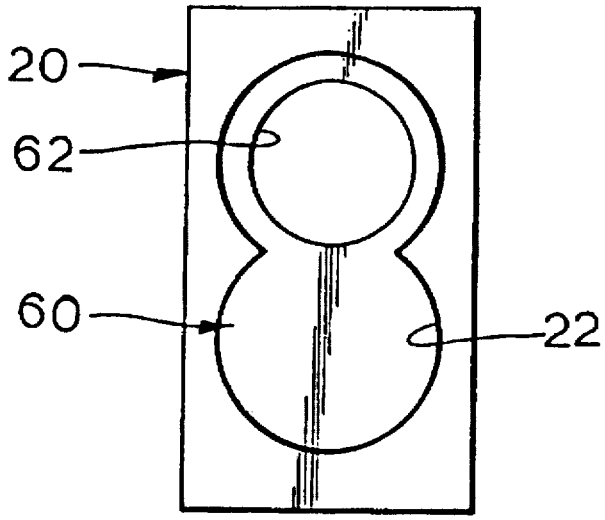
FIG. 32 is a view showing the spacer of FIG. 31 fitted in the axle support means of the arm member.

Another embodiment of the spacer 60*a* which may be fitted in the axle support means 22 of the arm member 20 is shown in FIGS. 31 and 32. The above spacer 60*a* has a circular ring part and a circular disc part which are vertically arranged up and down and integrated into a single body. That is, the above spacer 60*a* has an outer appearance which is similar to the arabian character 8 (=eight) and equal to the shape of the axle support means 22 of the arm member 20. The circular ring part of the spacer 60*a* has an axle support opening 62. The above spacer 60*a* not only allows the axle 15 to smoothly rotate but also improves compatibility of the arm member 20.

In the present invention, the arm block 21 of each arm member 20 may be provided with a balance 21A as shown in the dash and dot in FIG. 7. The balance 21A is for not only uniforming the centrifugal rotating force of the arm member 20 but also preventing undesired vibration of the roller skate 1 while roller skating. The balance 21A is formed in the arm block 21 such that the block 21 has a symmetrical shape except for the eccentric support hole 23A.

Figure 11:
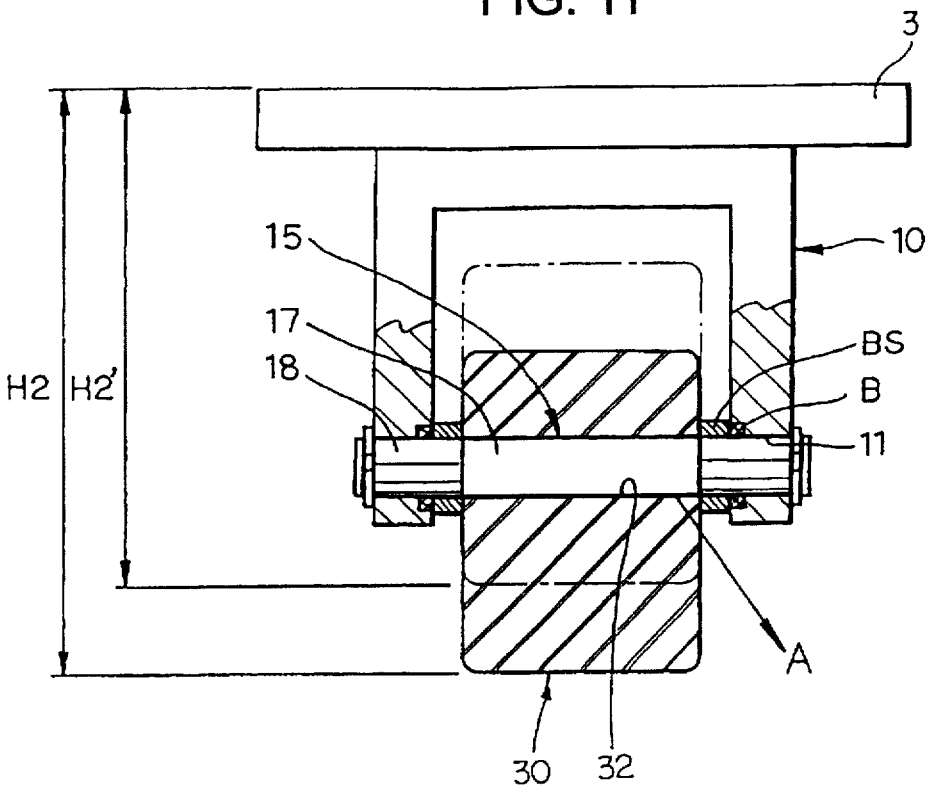
FIG. 11 is a sectional view of a rear wheel directly fitted over the middle portion of the rear axle eccentrically in accordance with another embodiment of the invention.

Turning to FIG. 11, there is shown another embodiment of the eccentric means of the roller skate of this invention. In this embodiment, the rear bracket 10 which is mounted to the shoe plate 3 has a pair of axle bearing arms. The opposite end portions of the rear axle 15 are rotatably received in axle holes 11 formed in the bearing arms of the bracket 10. The roller skate has one rear wheel 30 having an eccentric shaft hole 32. The rear wheel 30 is fitted over the middle portion of the axle 15 between the opposite axle bearing arms of the bracket 10.

Figure 15:
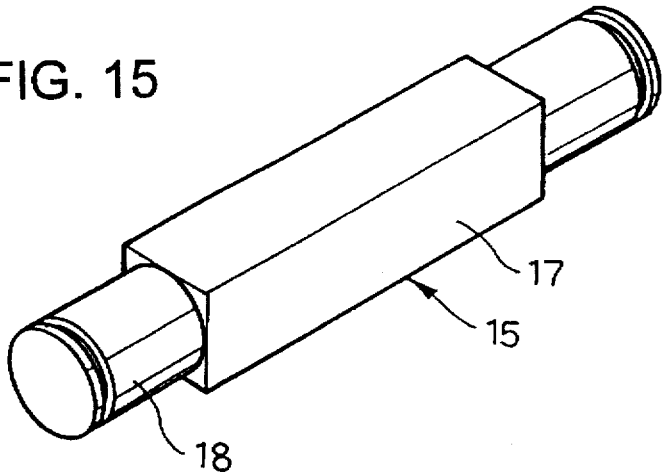
FIG. 15 is an enlarged perspective view of the rear axle A used in the embodiment of FIG. 11, the axle having a middle portion of square cross-section and the opposite end portions of circular cross-section.

The middle portion of the axle 15 used in the roller skate of FIG. 11 is a fixing part 17 of square cross-section, while the opposite end portions of the axle 15 are journal parts 18 of circular cross-section. The above axle 15 is shown in detail in FIG. 15.

The eccentric shaft hole 32 of the rear wheel 30 is a rectangular hole which meets with the fixing part 17 of square cross-section of the axle 15. Therefore, the rear wheel 30 does not rotate relative to the axle 15 but is fixed to the axle 15.

A bearing B is fitted over the axle 15 between the axle 15 and each bearing arm of the rear bracket 10 so that the axle 15 can be rotated in the axle hole 11 of the rear bracket 10. Fitted over the axle 15 between the wheel 30 and each bearing arm of the bracket 10 is a bush BS.

In operation of the above roller skate of FIG. 11, the eccentric rear wheel 30 fixedly fitted over the middle portion of the axle 15 eccentrically rotates along with the axle 15 about the center of the axle holes 11. Therefore, the height between the ground GR and the shoe plate 3 varies between the height H2 and the height H2' that the roller skate 1 of FIG. 11 bounces up and down while roller skating.

Figure 12:
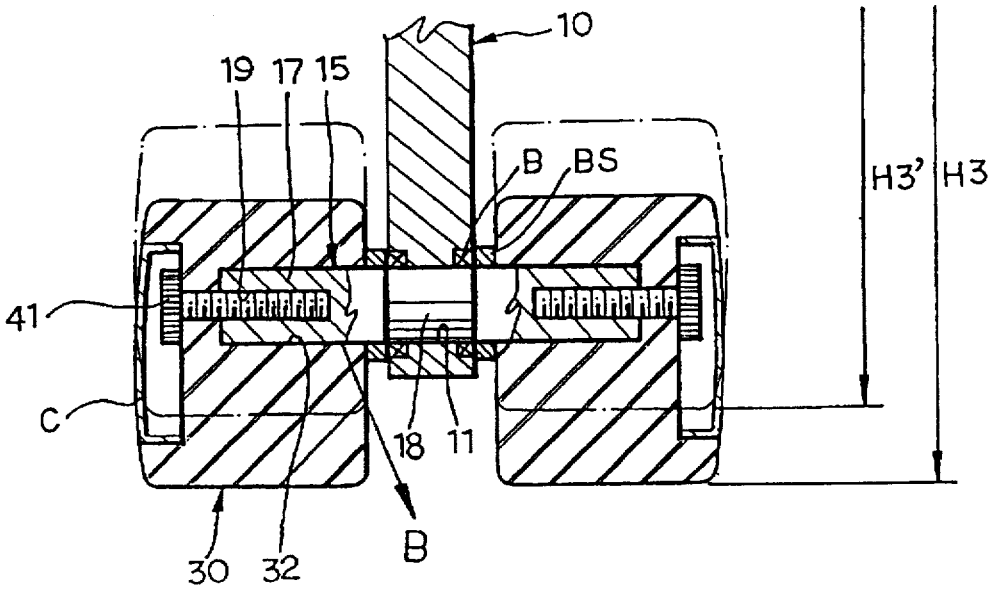
FIG. 12 is a sectional view of a pair of rear wheels directly fitted over the opposite end portions of the rear axle eccentrically in accordance with still another embodiment of the invention.

Turning to FIG. 12, there is shown still another embodiment of the eccentric means of the roller skate of this invention. In this embodiment, the rear bracket 10 mounted to the shoe plate 3 has one axle hole 11. The middle portion of the rear axle 15 is rotatably fitted in the axle hole 11 of the bracket 10 such that the opposite end portions of the axle 15 are exposed to the outside of the bracket 10. Two rear wheels 30 having their eccentric shaft holes 32 are fitted over and fixed to the opposite end portions of the axle 15 respectively.

Figure 16:
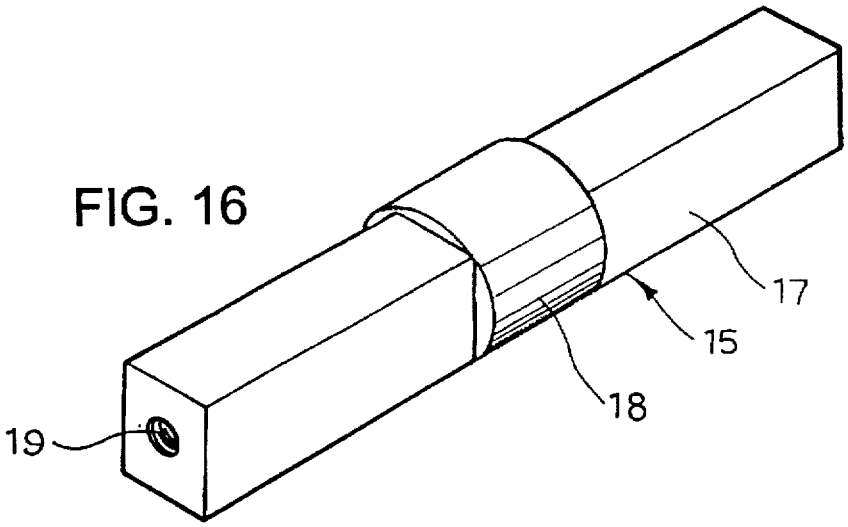
FIG. 16 is an enlarged perspective view of the rear axle B used in the embodiment of FIG. 12, the axle having a middle portion of circular cross-section and the opposite end portions of square cross-section.

In the above embodiment, the middle portion of the rear axle 15 is a journal part 18 of the circular cross-section, while the opposite end portions of the axle 15 are fixing parts 17 of square cross-section differently from the embodiment of FIG. 11. This axle 15 is shown in detail in FIG. 16.

The two rear wheels 30 having their eccentric shaft holes 32 are fixed to the opposite fixing parts 17 of the axle 15. A set screw 41 is inserted into a screw hole 19, which is longitudinally formed in an associated fixing part 17 of the axle 15, through a screw hole of each wheel 30 and in turn tightened, thereby tightly fixing each wheel 30 to an associated fixing part 17.

In operation of the above roller skate 1 of FIG. 12, the eccentric rear wheels 30 fixed to the opposite end portions of the axle 15 eccentrically rotate along with the axle 15 about the center of the axle hole 11 of the bracket 10. The height between the ground GR and the shoe plate 3 thus varies between the height H3 and the height H3' and bounces the roller skate 1 up and down while roller skating.

Differently from the roller skate of FIG. 11, the roller skate 1 of FIG. 12 has two eccentric rear wheels 30 at opposite end portions of the axle 15 so that this roller skate 1 improves operational efficiency and stability.

Figure 13:
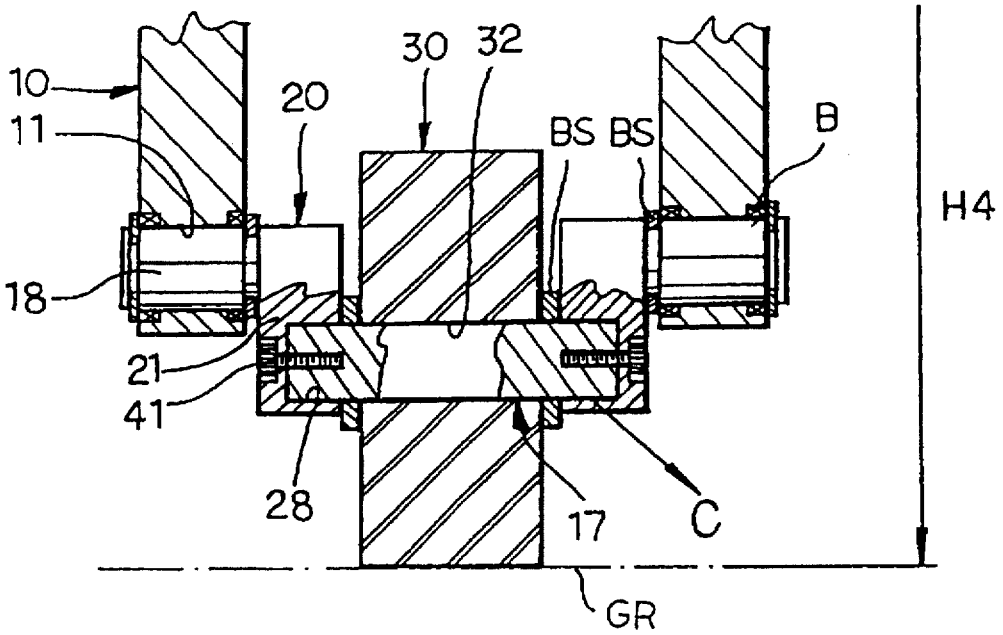
FIG. 13 is a sectional view of a rear wheel eccentrically coupled to the rear wheel using an eccentric arm member in accordance with yet another embodiment of the invention.
Figure 17:
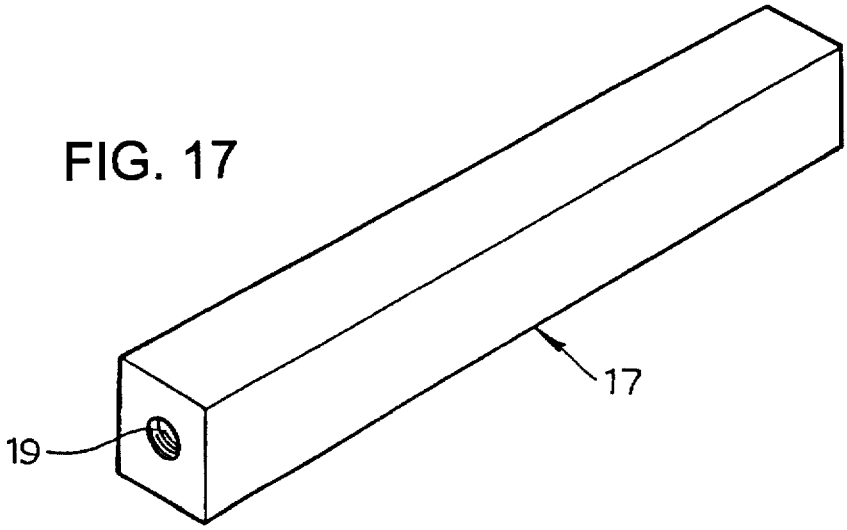
FIG. 17 is an enlarged perspective view of the rear axle C used in the embodiment of FIG. 13, the axle having a square cross-section body.

Referring next to FIG. 13, there is shown a further embodiment of the eccentric means of the roller skate of this invention. In this embodiment, the rear bracket 10 mounted to the shoe plate 3 has a pair of axle bearing arms in the same manner as described for the embodiment of FIG. 11. However, this embodiment has a pair of eccentric arm members 20 which are rotatably fitted in the axle holes 11 of the opposite axle bearing arms of the bracket 10. Each arm member 20 of this embodiment has a rear axle part 18 of circular cross-section extending outward from one side of the arm block 21. The axle part 18 of each arm member 20 is rotatably fitted in an associated axle hole 11 of the bracket 10 with interposition of bearings B. The other side of the arm block 21 has an shaft support recess 28 which will receive one end portion of a wheel fixing shaft 17. One rear wheel 30 is fixedly fitted over the middle portion of the shaft 17 of square cross-section. In this case, the wheel 30 having a center shaft hole 32 is concentrically fitted over the middle portion of the shaft 17. This shaft 17 of square cross-section is shown in detail in FIG. 17.

The opposite end portions of the above shaft 17 of square cross-section are fitted in and fixed to the rectangular shaft support recesses 28 of the arm members 20 respectively. A set screw 41 is inserted into the screw hole 19, longitudinally formed in an associated end portion of the shaft 17, through the screw hole of each wheel 30 and in turn tightened, thus to tightly fix each arm member 20 to the shaft 17.

Figure 14:
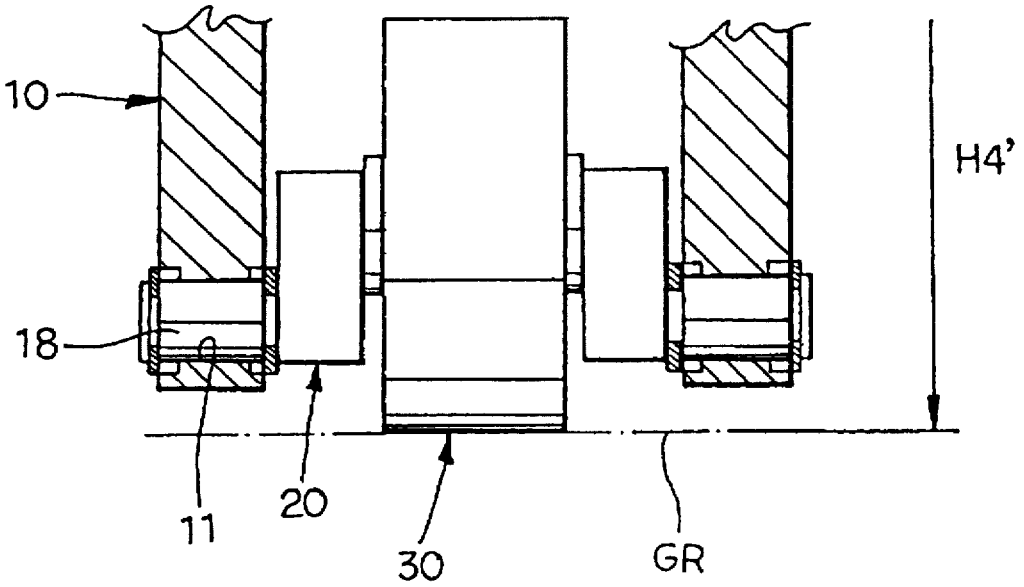
FIG. 14 is a view showing the uppermost position of the rear wheel of FIG. 13.

In operation of the above roller skate 1 of FIG. 13, the rear wheel 30 fixedly fitted over the middle portion of the shaft 17 eccentrically rotates along with both the shaft 17 and the arm members 20 about the center of the axle holes 11 of the bracket 10. Therefore, the height between the ground GR and the shoe plate 3 varies between the height H4 of FIG. 13 and the height H3' of FIG. 14 so that the above roller skate 1 bounces up and down while roller skating.

Fitted over the shaft 17 between each bearing arm of the bracket 10 and the arm block 21 of an associated arm member 20 is a bush BS for improving the operational efficiency of the roller skate 1.

Figure 18:
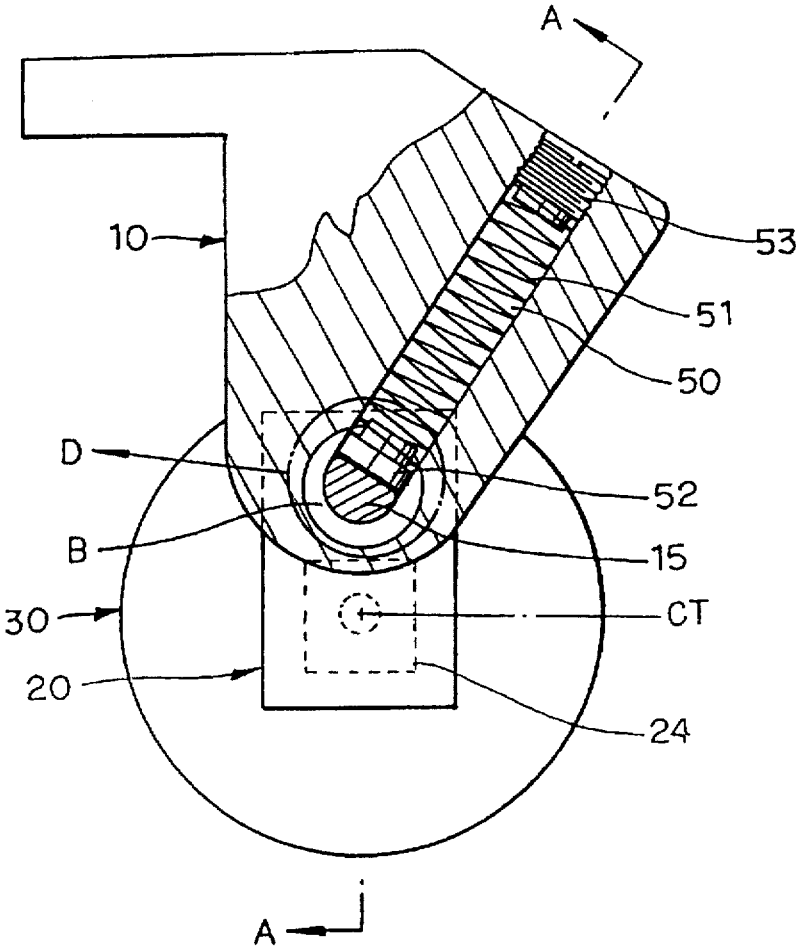
FIG. 18 is a sectional view of a roller skate having speed reduction means in accordance with a further embodiment of the invention.

In order to improve the stability of the bouncing roller skate 1 of this invention, speed reduction means for reducing the eccentric rotational force of the rear axle and keeping the uniform rotational force may be preferably provided in the rear bracket 10 as shown in FIG. 18.

As shown in FIG. 18, the speed reduction means includes a coil spring 51 which selectively applies frictional contact force for the axle 15, rotating along with the rear wheel 30, and acts as a brake for the axle 15. The spring 51 is received in an elongated spring hole 50 formed in the rear bracket 10 above the axle 15.

Figure 20:
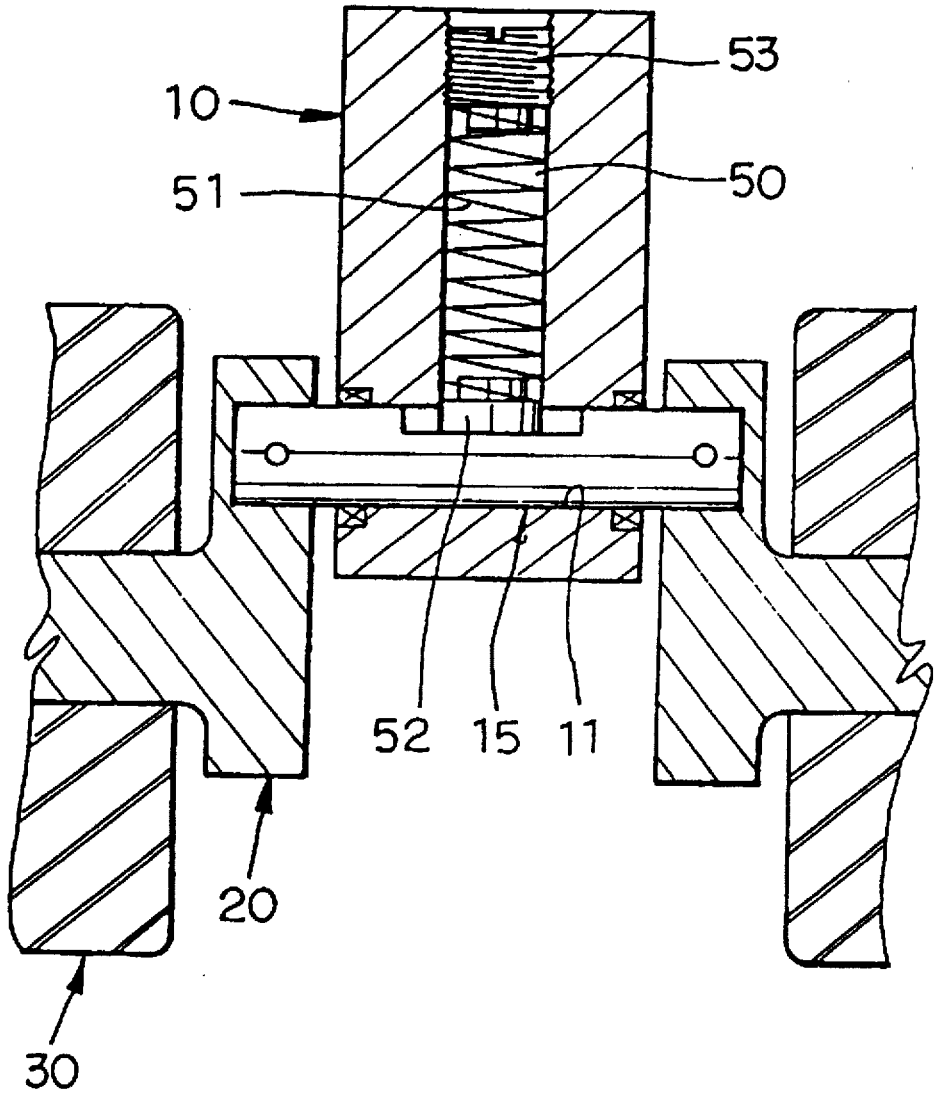
FIG. 20 is a sectional view of the rear wheel part with the speed reduction means taken along the section line A—A of FIG. 18.

Interposed between the spring 51 and the axle 15 is a stopper 52. The spring hole 50 of the bracket 10 is a through hole whose top is threaded to form an inner threaded top part. A spring force adjusting screw 53 is movably fitted in the threaded top part of the hole 50. In the embodiment of FIG. 18, the axle 15 has a cam portion having a flat round surface. The cam portion is formed in the middle portion of the axle 15. At the cam portion, the axle 15 selectively comes into contact with the stopper 52 as shown in FIG. 20.

Figure 19:
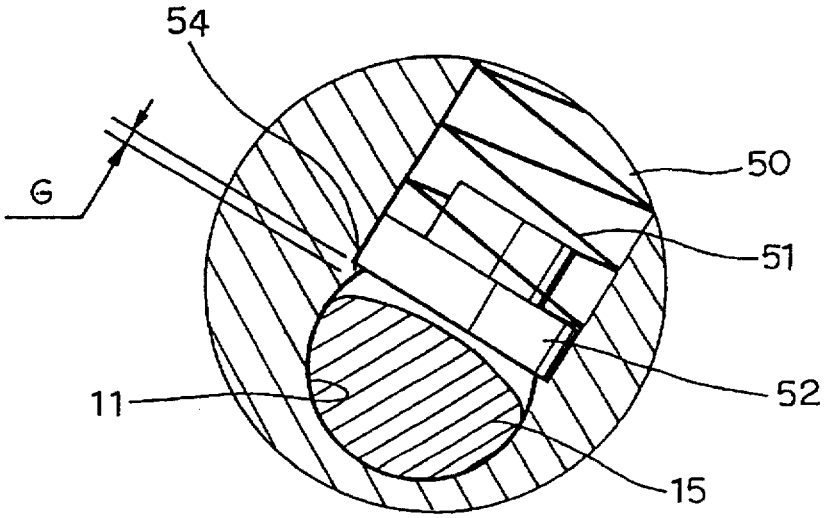
FIG. 19 is an enlarged sectional view of the portion D of FIG. 18.

The spring force adjusting screw 53 is movable in the hole 50 so as to adjust the spring force of the spring 51 as desired. As shown in FIG. 19, a step 54 is formed in the lower portion of the hole 50. The above step 54 selectively seats the stopper 52 thereon to selectively form a gap G between the stopper 52 and the flat round surface of the axle 15 exclusively when the center CT of the wheel 30 is positioned below the axle 15 during the eccentric rotating motion of the wheel 30.

The operational effect of the above speed reduction means will be described hereinbelow.

Please let a state in that the center CT of the wheel 30 fixed to the arm member 20 is positioned below the axle 15 as shown in FIG. 18 be the initial state of the bouncing operation of the roller skate. In the above initial state, the spring-biased stopper 52 is seated on the step 54 of the hole 50 so that the predetermined gap G is formed between the stopper 52 and the flat round surface of the cam axle 15 rotatably fitted in the axle holes 11 of the bracket 10.

The gap G is formed for preventing possible interference between the stopper 52 and the axle 15 due to the axle 15 rotating along with the wheel 30 in the initial state of eccentric rotation of the wheel 30. The gap G thus causes the axle 15 to smoothly rotate during the above initial state.

Figure 21:
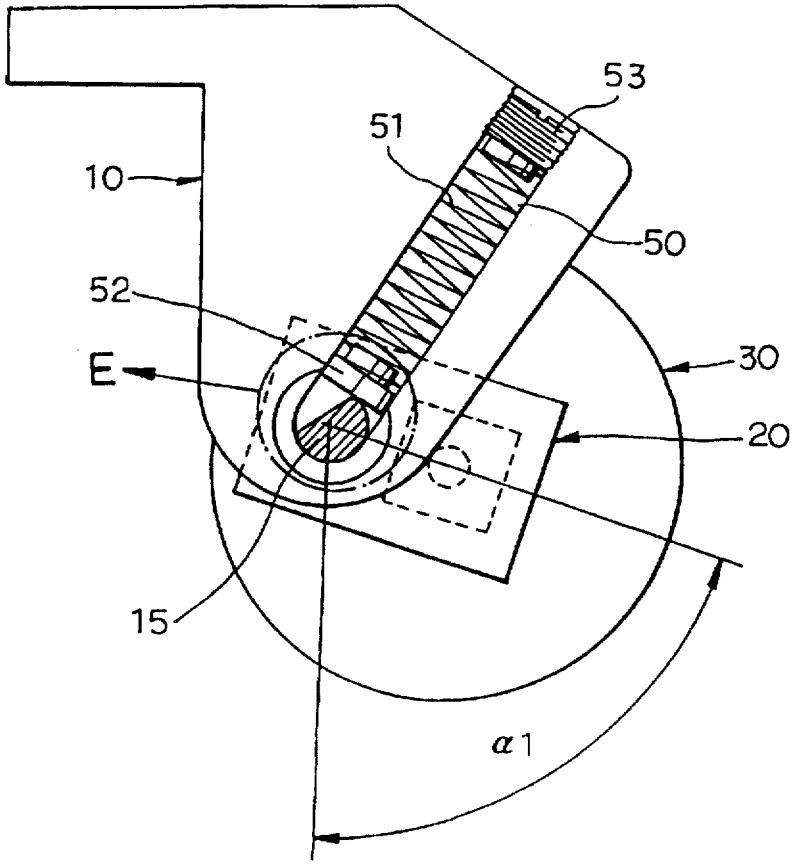
FIG. 21 is a view showing the initial position or the first position of the rear wheel of FIG. 18.
Figure 22:
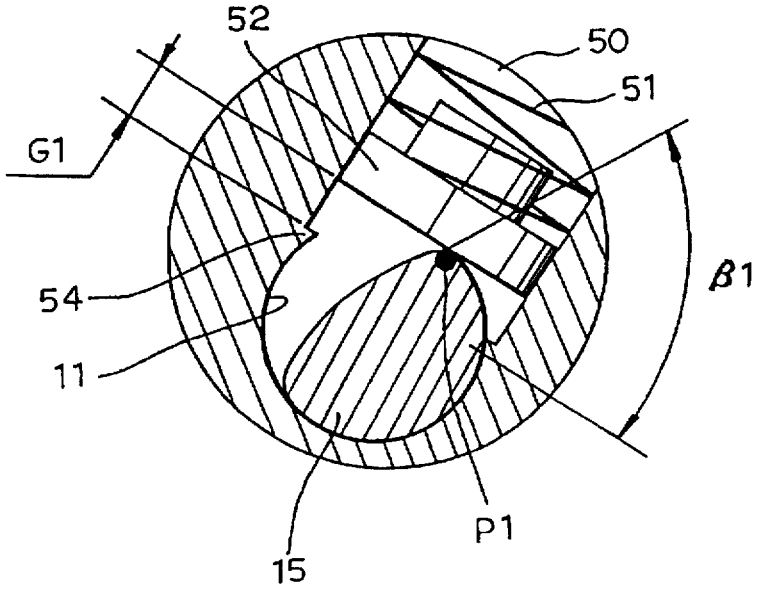
FIG. 22 is an enlarged sectional view of the portion E of FIG. 21.

When the wheel 30 eccentrically rotates counterclockwise by an angular moving distance $\alpha 1$ as shown in FIG. 21, the cam axle 15 fixed to the arm members 20 rotates in the same direction so that a corner P1 of the cam portion of the axle 15 moves up by an angular moving distance $\beta 1$ as shown in FIG. 22. The corner P1 in this case forcibly pushes up the stopper 52 while slightly compressing the spring 51, thus to form a gap G1 between the step 54 and the stopper 52.

Figure 23:
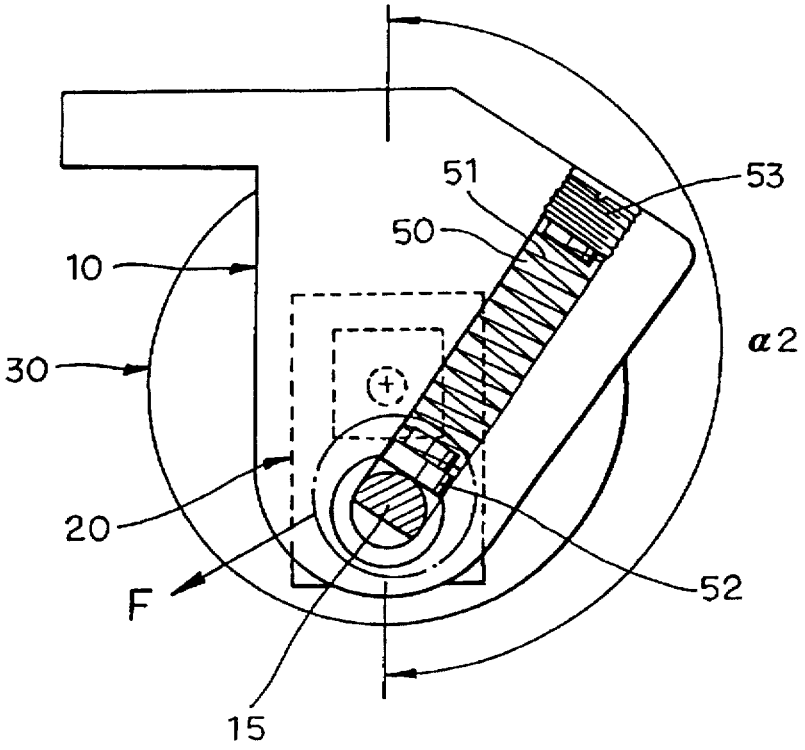
FIG. 23 is a view showing the uppermost position or the second position of the rear wheel of FIG. 18.
Figure 24:
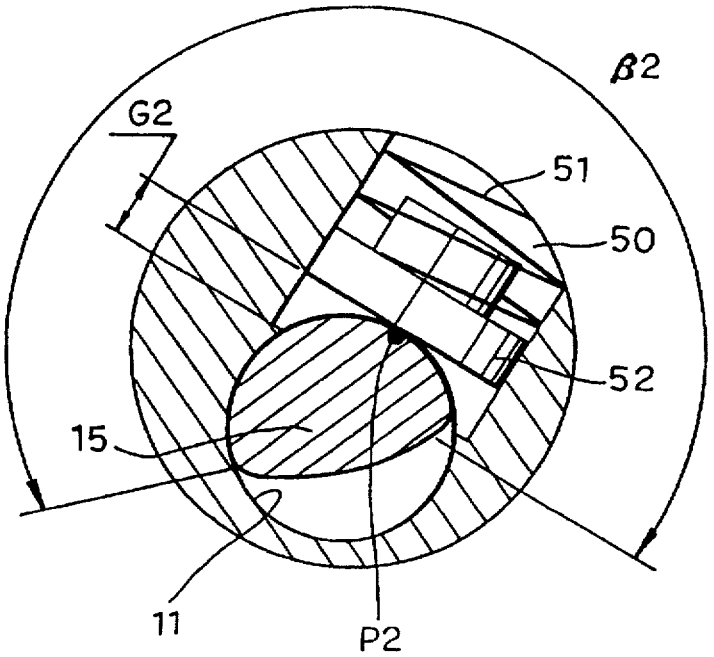
FIG. 24 is an enlarged sectional view of the portion F of FIG. 23.

Thereafter, the wheel 30 further rotates to achieve the uppermost position as shown in FIG. 23. At the same time of the above further rotation of the wheel 30, the axle 15 rotates in the same direction as shown in FIG. 24. The angular moving distance of the wheel 30 during the above further rotation is $\alpha 2-\alpha 1$, while the angular moving distance of the axle 15 is $\beta 2-\beta 1$. In this case, a point P2 of the cam portion of the axle 15 pushes up the stopper 52 while compressing the spring 51, thus to form a gap G2 between the step 54 and the stopper 52.

As the cam portion of the axle 15 pushes up the stopper 52 as described above, the inertia force remaining in the axle 15 due to rotation of the wheel 30 will be offset by the stopper 52.

Figure 25:
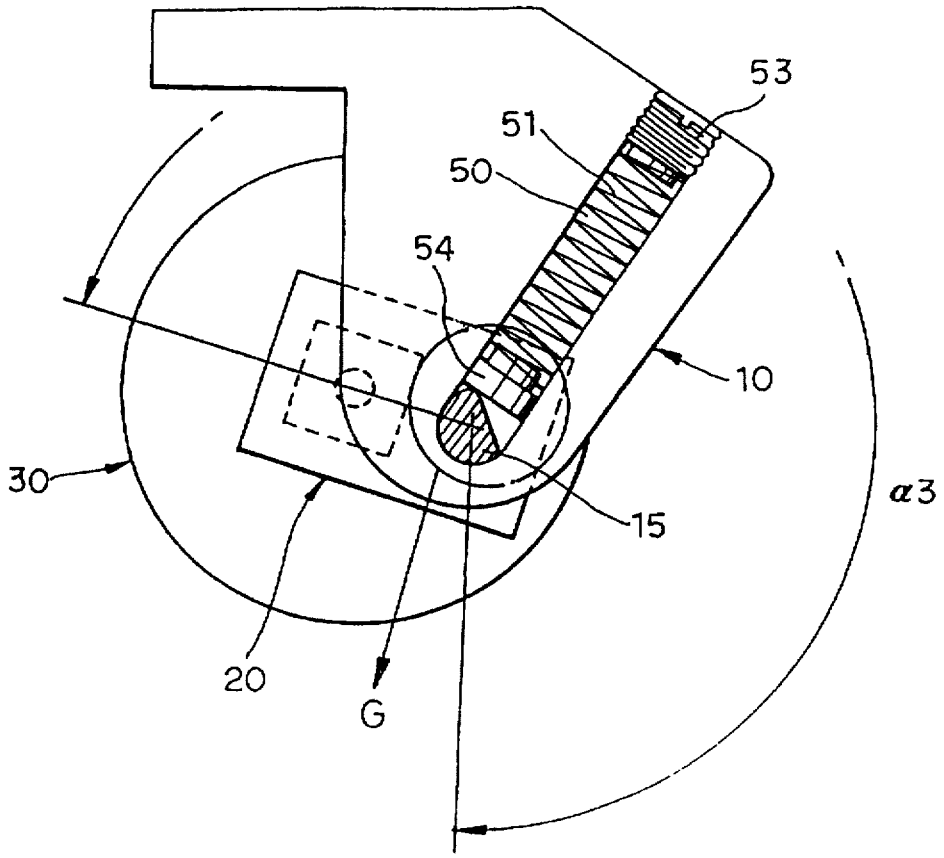
FIG. 25 is a view showing the third position of the rear wheel of FIG. 18.
Figure 26:
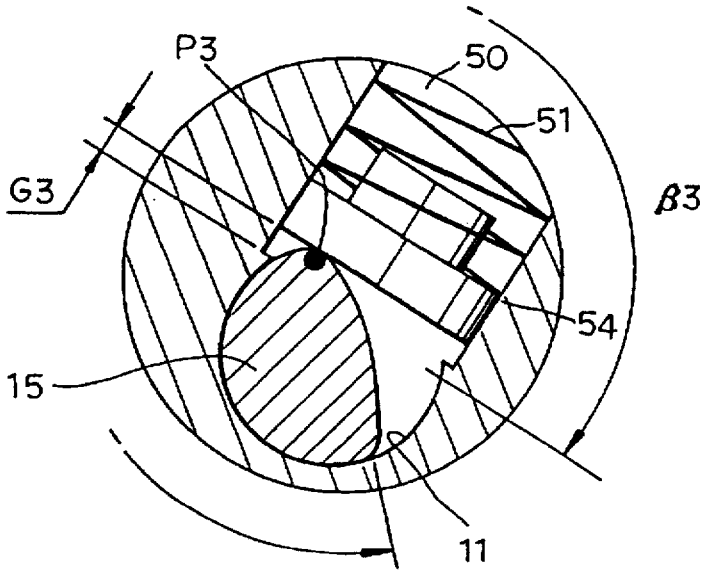
FIG. 26 is an enlarged sectional view of the portion G of FIG. 23.
Figure 27:
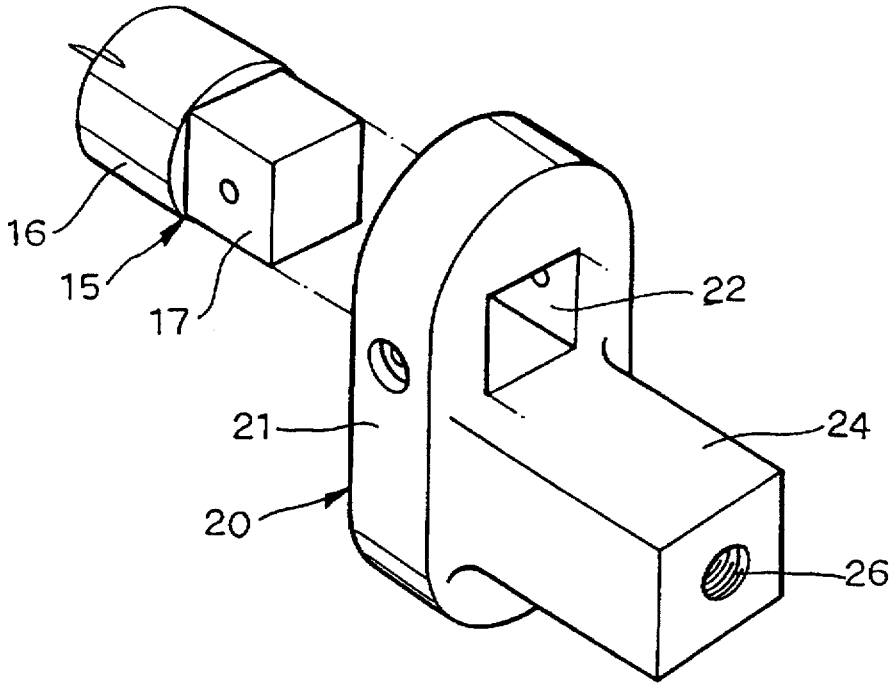
FIG. 27 is a perspective view of a fifth embodiment of the eccentric arm member of the invention.
Figure 28:
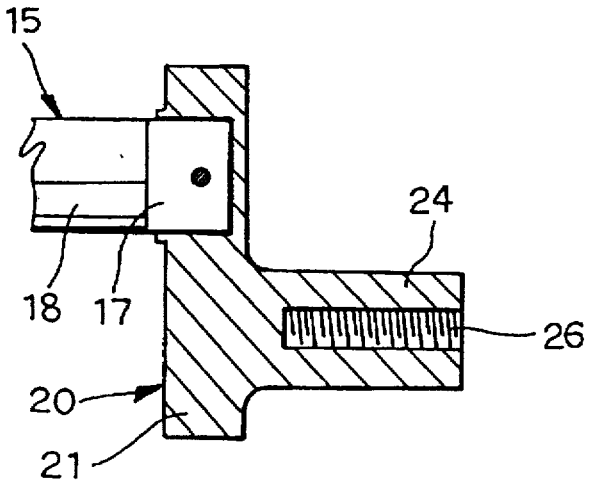
FIG. 28 is a sectional view of the arm member of FIG. 27 fixed to one end of the rear axle.

When the wheel 30 further rotates to achieve the position of FIG. 25, the axle 15 rotates in the same direction as shown in FIG. 26. In the above further rotation of the wheel 30, the angular moving distance of the wheel 30 is $\alpha 3-\alpha 2$, while the angular moving distance of the axle 15 is $\beta 3-\beta 2$. The other corner P3 of the cam portion of the axle 15 in this state comes into frictional contact with the stopper 52 as best seen in FIG. 26. Severe friction will be thus generated between the corner P3 and the stopper 52 if there is no means for reducing the rotational force of the axle 15. However, the severe friction which will be generated between the corner P3 and the stopper 52 can be prevented by the speed reduction means of the invention. That is, the speed reduction means somewhat reduces the rotational force of the axle 15, thus to prevent this kind of severe friction between the point P3 and the stopper 52. Hence, the axle 15 along with the wheel 30 can smoothly return to the initial position of FIG. 9.

The wheel 30, which has returned to its initial position, repeats the above-mentioned process due to the inertia force caused by the eccentric rotation of the wheel 30.

Due to the above speed reduction means, the eccentric rotating speed of the wheel 30 can be kept uniform so that the roller skate of this invention can be easily operated.

In the bouncing roller skate of this invention, the rear wheel may eccentrically rotate while bouncing the skate up and down with a wave trace or concentrically rotates in the same manner as described for a typical roller skate with a linear trace. The bouncing roller skate thus provides the skater with thrills and satisfaction due to the eccentric rotation of the rear wheel.

As described above, the present invention provides a bouncing roller skate whose rear wheel is eccentrically or concentrically coupled to a rear bracket by means of eccentric means. The rear wheel coupled to the rear bracket by means of the eccentric means thus eccentrically or concentrically rotate relative to the rear bracket, thereby performing a bounce running motion with a wave trace or a horizontal running motion with a linear trace while roller skating. The above roller skate thus increases the skater's motion and provides the skater with thrills and satisfaction.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A bouncing roller skate comprising:

a rear bracket mounted to the rear bottom of a shoe plate, said bracket having a bearing hole with a central transverse axis;

a rear wheel having a central transverse axis; and eccentric means for eccentrically coupling the rear wheel to the bearing hole with the central transverse axis of the rear wheel being radially offset from the central transverse axis of the bearing hole and rotating the rear wheel eccentrically about the central transverse axis of the bearing hole and selectively bouncing the roller skate up and down while roller skating, said eccentric means comprising:

a rear axle rotatably fitted in said bearing hole of the rear bracket such that opposite end portions of the rear axle are exposed to the outside of the rear bracket, each end portion of said rear axle having a radial arm fixing hole; and an eccentric arm member fixed to each end portion of the rear axle such that said arm member is eccentrically rotated along with the rear axle about the central transverse axis of said bearing hole, said arm member in turn being fixed to said rear wheel such that the rear wheel is eccentrically rotated along with both the rear axle and the arm member about the central transverse axis of said bearing hole, said arm member comprising:

an arm block;

axle support means for receiving and supporting each end portion of the rear axle, said axle support means being formed on one side of said arm block;

a wheel shaft integrally extending from the other side of the arm block such that the wheel shaft is eccentric from the rear axle supported by the axle support means; and an axle fixing hole formed in the arm block such that the axle fixing hole is perpendicular to and communicates with the axle support means, said axle fixing hole being aligned with said radial arm fixing hole of the rear axle and receiving a set screw for fixing the arm member to the rear axle;

wherein said rear wheel has a central shaft hole for permitting the rear wheel to be non-rotatably attached to the wheel shaft of the arm member.

2. The bouncing roller skate according to claim 1, wherein said axle support means of the arm member comprises a plurality of axle support recesses which are arranged in the arm block in a radially spaced manner relative to the central transverse axis of the bearing hole.

3. The bouncing roller skate according to claim 2, wherein said axle support recesses partially overlap each other so as to communicate with each other.

4. The bouncing roller skate according to claim 3, further comprising a spacer fitted in an empty support recess of the arm member, said spacer having an arcuate support surface for rotatably supporting the rear axle.

5. The bouncing roller skate according to claim 3, further comprising a spacer fitted in said axle support means, said spacer having a support opening for rotatably supporting the rear axle, the shape of said spacer being equal to the shape of said axle support means of the arm member.

6. The bouncing roller skate according to claim 1, wherein said rear axle is a cylindrical axle.

7. The bouncing roller skate according to claim 1, wherein said wheel shaft of the arm member is a polygonal shaft.

8. The bouncing roller skate according to claim 1, wherein said arm block of the arm member has two opposed portions extending radially from an inner end of said wheel shaft, one of the opposed portions having said axle support means formed therein and the other one of the opposed portion functioning as a balance member for maintaining a uniform centrifugal rotating force of the arm member.

9. The bouncing roller skate according to claim 1, wherein said central shaft hole of the rear wheel is a polygonal hole.

10. The bouncing roller skate according to claim 1, further comprising:

speed reduction means for reducing rotational speed of said rear axle and for maintaining a uniform speed of rotation, said speed reduction means being provided in the rear bracket.

11. The bouncing roller skate according to claim 1, wherein said rear axle has a cam portion having a flat round surface, said cam portion selectively coming into contact with the stopper.

12. The bouncing roller skate according to claim 10, wherein said speed reduction means comprises:

an elongated spring hole formed in the rear bracket above the rear axle, the lower portion of said spring hole having a step;

a spring received in said spring hole;

a stopper interposed between said spring and said rear axle and movably seated on the step of the spring hole, said stopper selectively applying frictional contact force for the rear axle and acting as a brake for the axle; and a spring force adjusting screw fitted in the top of said spring hole such that the screw is driven at the outside of the rear bracket.

13. The bouncing roller skate according to claim 12, wherein said spring force adjusting screw is movable in the spring, hole so as to adjust the spring force of said spring.

14. The bouncing roller skate according to claim 1, wherein said axle support means of the arm member has polygonal appearance.

15. The bouncing roller skate according to claim 14, wherein each end portion of said rear axle fitted in said axle support means has a polygonal cross-section.

* * * * *